United States Patent [19]

Cycowicz et al.

[11] 4,195,878

[45] Apr. 1, 1980

[54] RECLINING CHAIR

[75] Inventors: Izchak Cycowicz, Brooklyn, N.Y.; Robert J. Caldwell, Bloomfield, N.J.

[73] Assignee: Mohasco Corporation, Amsterdam, N.Y.

[21] Appl. No.: 845,065

[22] Filed: Oct. 25, 1977

[51] Int. Cl.[2] ..... A47C 1/02

[52] U.S. Cl. ..... 297/83; 297/318; 297/DIG. 4

[58] Field of Search ..... 297/83, 88, 318, 316, 297/DIG. 4, DIG. 7, 340; 248/430, 429; 312/34; 308/3.6

[56] References Cited

U.S. PATENT DOCUMENTS

| | | | |
|---|---|---|---|
| Re. 29,483 | 11/1977 | Re' | 297/88 |
| 2,227,884 | 1/1941 | Gymer et al. | 312/341 R |
| 3,259,432 | 7/1966 | Jackson | 297/DIG. 4 |
| 3,858,932 | 1/1975 | Crum et al. | 297/83 X |
| 4,004,772 | 1/1977 | Pickles | 249/430 |
| 4,072,342 | 2/1978 | Johnson | 297/88 |
| 4,077,663 | 3/1978 | Cycowicz | 297/83 |

FOREIGN PATENT DOCUMENTS

| | | | |
|---|---|---|---|
| 316434 | 12/1971 | U.S.S.R. | 312/341 R |

*Primary Examiner*—James T. McCall
*Attorney, Agent, or Firm*—Kirschstein, Kirschstein, Ottinger & Cobrin

[57] ABSTRACT

A wall clearing reclining chair has two extension links which transmit forces which are generated during reciprocating movement of an armrest assembly at the armrest-mounting members thereof directly to base drive pivot pins which are located forwardly and downwardly relative to the armrest-mounting members. The chair also has wheel-mounted movable tracks which are reinforced at the wheel mountings. Stops are provided for affirmatively arresting movement of the chair seat in its closed upright position. Caster wheel assemblies are mounted at the rear of the chair. Hardware for this chair is likewise disclosed.

41 Claims, 10 Drawing Figures

RECLINING CHAIR

This invention relates to chairs. One object of this invention is to generally improve the chair disclosed in copending application Ser. No. 683,480, filed May 5, 1976 for RECLINER CHAIRS now U.S. Pat. No. 4,077,663 issued Mar. 7, 1978.

In said copending application, the side arms of the chair body were interconnected by an armrest wood cross-brace adjacent the lower front ends of the side arms, and the front base drive bell cranks had arms pivoted to brackets fixed to said armrest cross brace. Each of the front bell cranks, at opposite sides of the chair, had to be made of three parts so as to straddle the armrest cross brace. Furthermore, the armrest cross brace being made of wood could not stand up to the strains and impacts of the bell cranks thereon, in use. It is hence another object of this invention to obviate such difficulty, by affixing metal reinforcement extension members to the armrest mounting members affixed to the inner sides of the side arms or arm rests which form part of the chair body, and to pivot an arm of each bell crank to one of said extension members. With such construction, the armrest wood cross brace connecting the side arms could be eliminated, and further each bell crank could be made of one piece since it is no longer necessary to straddle the armrest cross brace.

In said copending application, the movable tracks were attached only to vertical sides of the side arms, and the stationary tracks comprised metal of one thickness throughout. Thus the top wheel at the rear end of each movable track was mounted on the vertical wall of the movable track which was attached to the vertical inner surface of a side arm. The support for such rear wheels presented a difficulty as being at times inadequate. It is hence a further object of this invention to obviate such difficulty by attaching a horizontal wall of the movable track to the underside of the side arm, and employing a heavier more rigid angle iron, and attaching the horizontal flange of said angle iron to a rear depressed portion of the horizontal wall of the movable track, with the vertical flange of said angle iron projecting upwardly inside of the side arm, and mounting the rear top wheel on such vertical flange, thereby achieving a strong, rugged and durable construction.

Yet another object of this invention is to provide a chair of the character described in which caster assemblies are mounted beneath the rear ends of the stationary tracks to permit the front end of the chair base to be raised for tilting the chair on the casters to allow the chair to be more easily moved on a floor from one location to another.

Still another object of this invention is to provide a chair of the character described in which highly improved stops are mounted at the rear end of the movable tracks to abut against complementary stops at the rear ends of the stationary tracks to stop movement of the chair body rearwardly when the chair reaches its upright position.

Yet a further object of this invention is to provide in a chair of the character described, a stationary track comprising a horizontal bottom flange resting on a front transverse cross-brace, a vertical web extending up from the horizontal flange, and supporting a bottom front wheel rotatably mounted thereon, a movable track having a horizontal wall resting on top of said bottom front wheel, a vertical longitudinal flange projecting down from said horizontal wall and disposed between said bottom front wheel and said vertical web of said stationary track, and anti-friction glide means fixed to said vertical web and adapted to contact said vertical longitudinal flange of said movable track.

Yet a further object of this invention is to provide in a chair of the character described, a top rear wheel rotatably mounted on an axle fixed to the vertical flange of the angle iron mounted on the horizontal wall of the movable track, said stationary track having a vertical flange extending upwardly from the horizontal web of said stationary track, and between the top wheel on the movable track and said vertical flange of said angle iron, and an anti-friction disc mounted on said axle between said vertical flange of said angle iron, and said upwardly extending vertical flange of said stationary track.

Yet a further object of this invention is to provide in a chair of the character described, an upwardly projecting knob on the horizontal wall of the movable track near the rear end of said movable track, underlying and somewhat spaced from said horizontal web of said stationary track to limit upward movement of said movable track relative to said stationary track, and a downwardly extending knob at the underside of the front end of the horizontal web of said stationary track projecting toward and overlying said horizontal wall of said movable track but somewhat spaced therefrom to limit movement of the front end of said movable track upwardly relative to said stationary track.

In said copending application, the armrest cross brace connecting the lower front ends of the chair arms was so positioned that the linkage for the leg rest had to be designed so as not to strike said armrest cross brace as the chair moved from upright to T.V. position, but to move above it. This difficulty imposed restraints on the design of the leg rest and its projecting and retracting linkage. This difficulty is obviated by eliminating said front armrest cross-brace. While the aforementioned front bell cranks are interconnected by a cross brace, the front lower ends of the side arms of the chair are not interconnected by a cross brace, and the leg rest projecting linkage can move below and past the position where the cross brace for the side arms was located in said copending application, because said leg rest projecting mechanisms are located between the bell cranks and the side arms.

Yet another object of this invention is to provide a strong, rugged and durable chair of the character described which shall be relatively inexpensive to manufacture, easy to assemble and manipulate, and which shall yet be practical and efficient to a high degree in use.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the following claims.

IN THE DRAWINGS

DETAILED DESCRIPTION OF THE PREFERRED EMBODIMENTS

Figure 1:
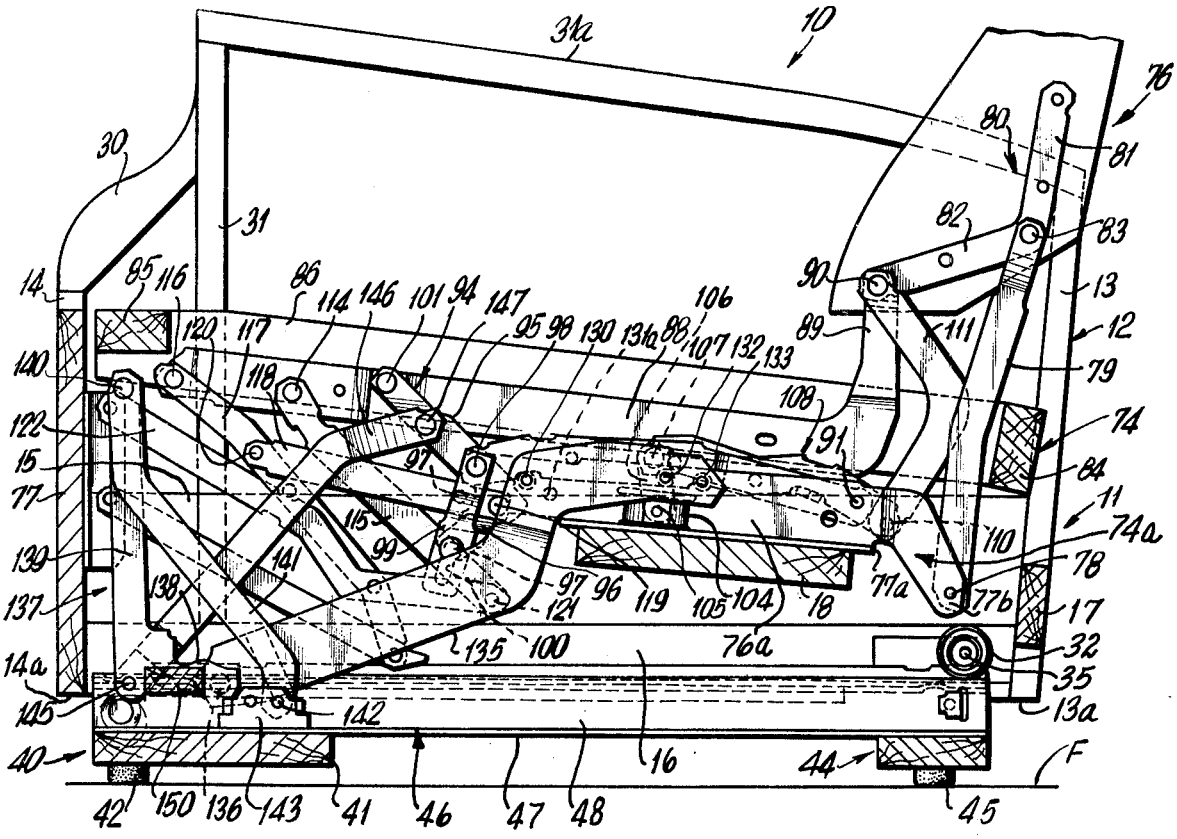
FIG. 1 is a cross-sectional view of a chair embodying the invention taken in a vertical plane and showing the inside of the hardware on the right side of the chair and with the chair in upright position.

Referring now in detail to FIGS. 1 to 7 of the drawing, 10 designates a chair embodying the invention. Only the right side of the chair is shown. However the left side of the chair is similar and symmetrically disposed to the right side, so that only the right side need be shown and described.

Figure 2:
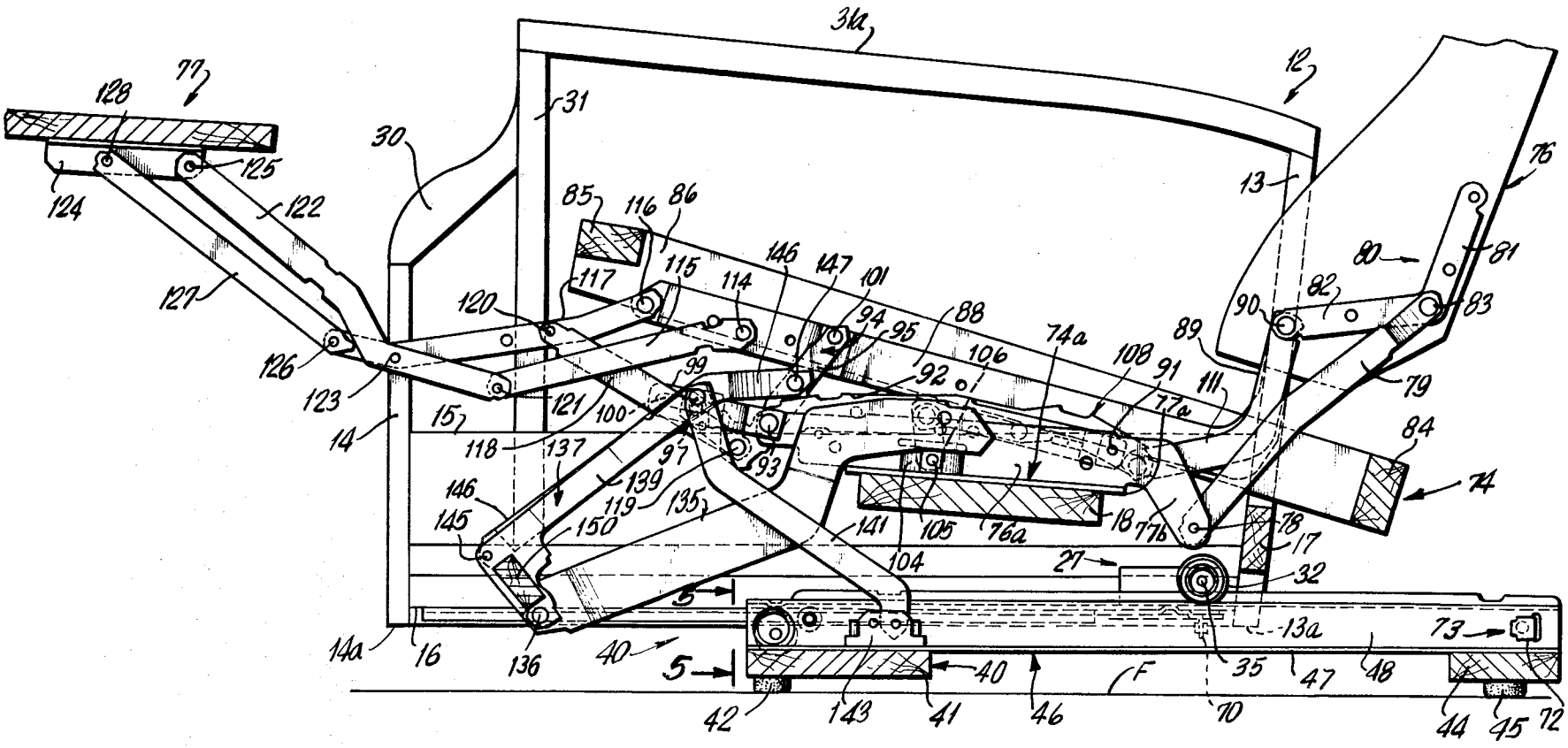
FIG. 2 is a view similar to FIG. 1, but showing the chair in T.V. position.
Figure 3:
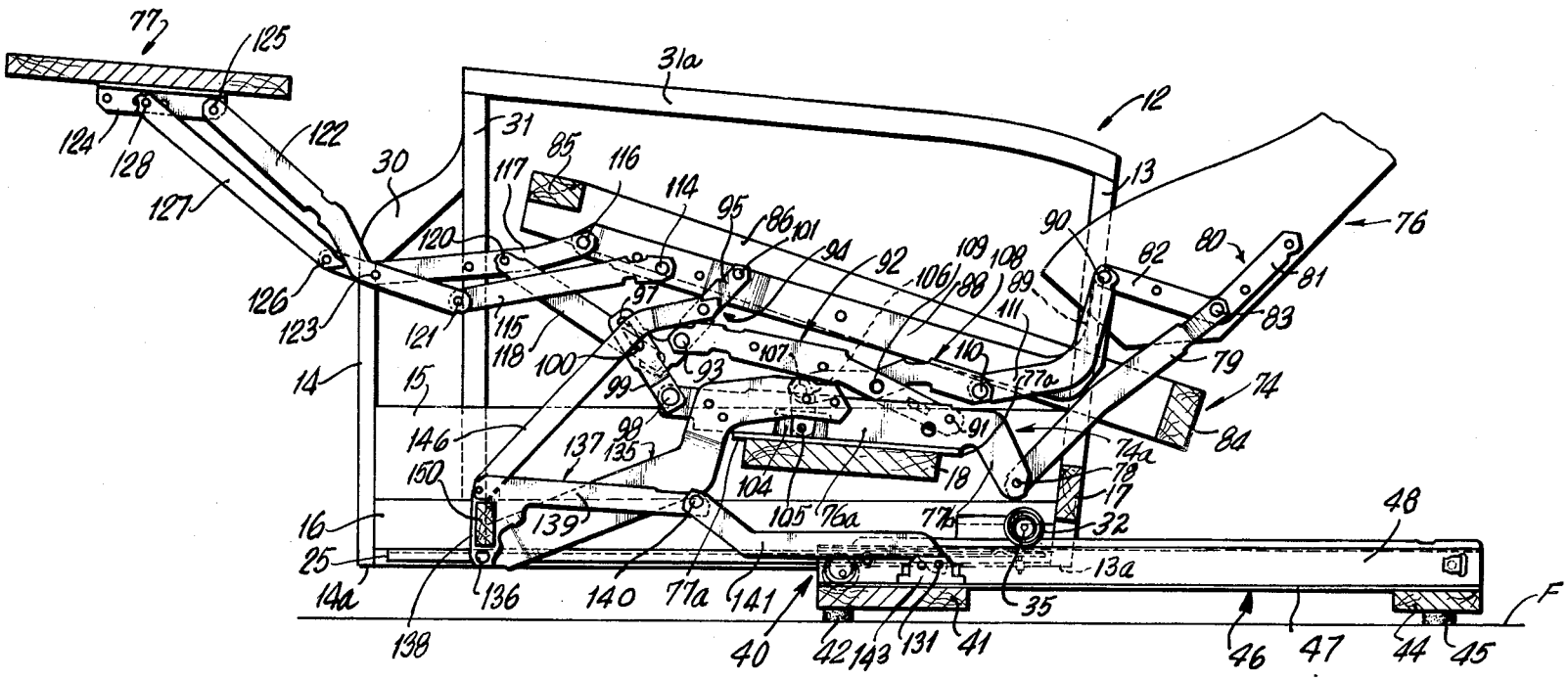
FIG. 3 is a view like FIG. 2, but showing the chair in fully reclined position.

As shown in FIGS. 1-3, chair 10 comprises a body 11 made of wood. Body 11 comprises arm rests 12. Each arm rest comprises a rear post 13 and a front post 14 connected by a horizontally extending brace 15 in a vertical plane and a bottom brace 16 extending horizontally in a horizontal plane.

The rear posts 13 are connected by a cross brace 17. Posts 13 and 14 extend below brace 16 to lower edges 13*a* and 14*a*, respectively.

Braces 15 are connected by a substantially horizontal cross-brace 18. Only the arm rest on the right side of the chair is shown in the drawing.

Figure 4:
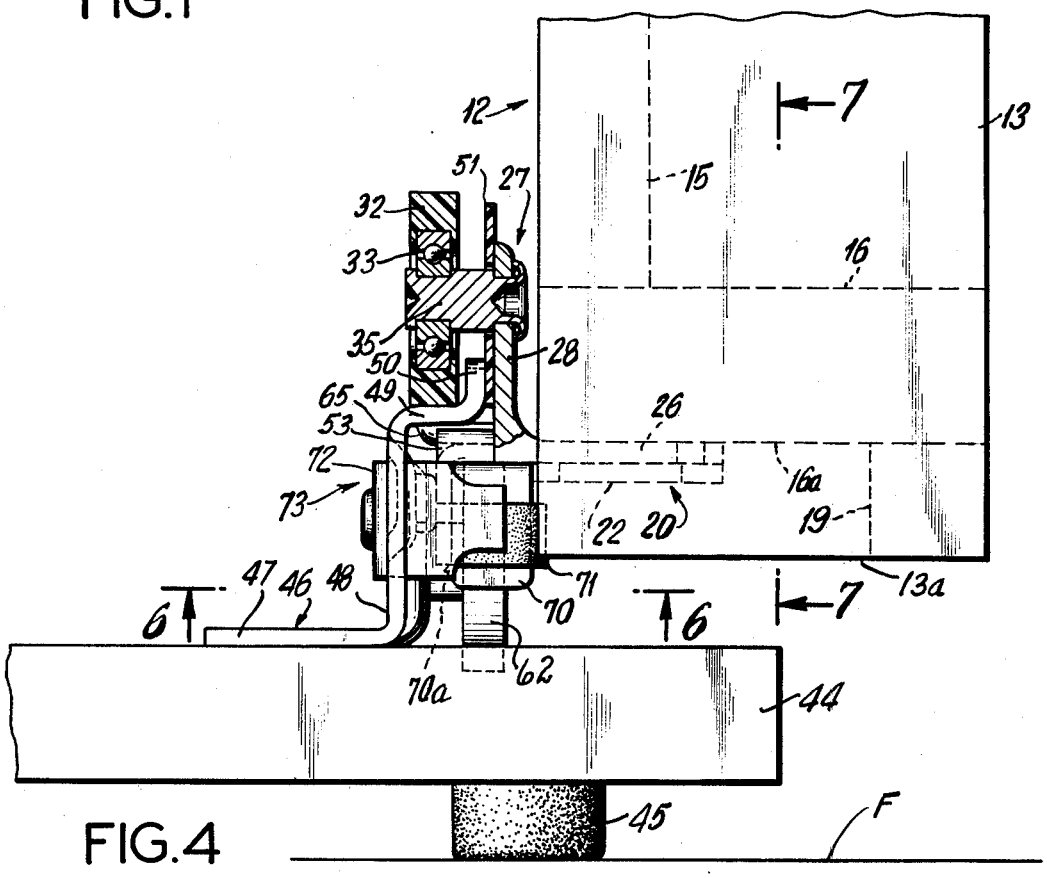
FIG. 4 is a partial rear view of the lower right side of the chair of FIG. 1, but with parts in cross-section.
Figure 6:
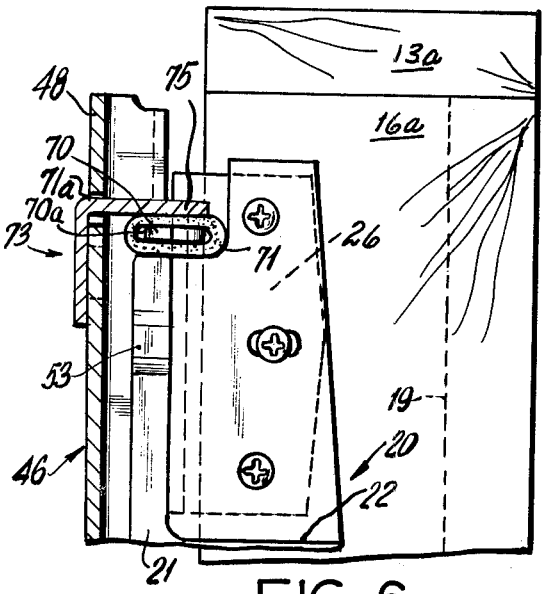
FIG. 6 is a cross-sectional view taken on line 6—6 of FIG. 4.

Attached to the lower ends of posts 13, 14 and below brace 16 is a brace 19 adjacent the outer edges of said posts, as best shown in FIGS. 4 and 6.

Figure 5:
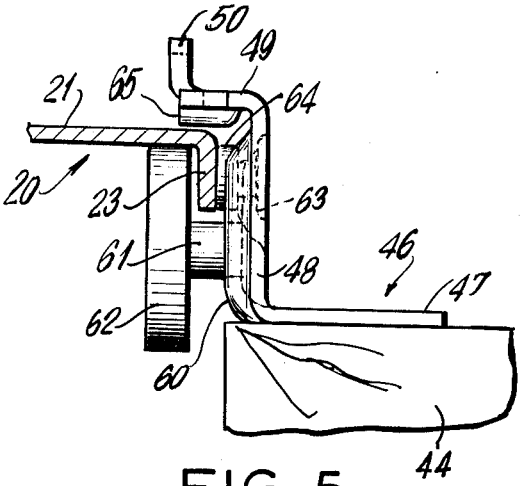
FIG. 5 is a cross-sectional view taken on line 5—5 of FIG. 2.
Figure 7:
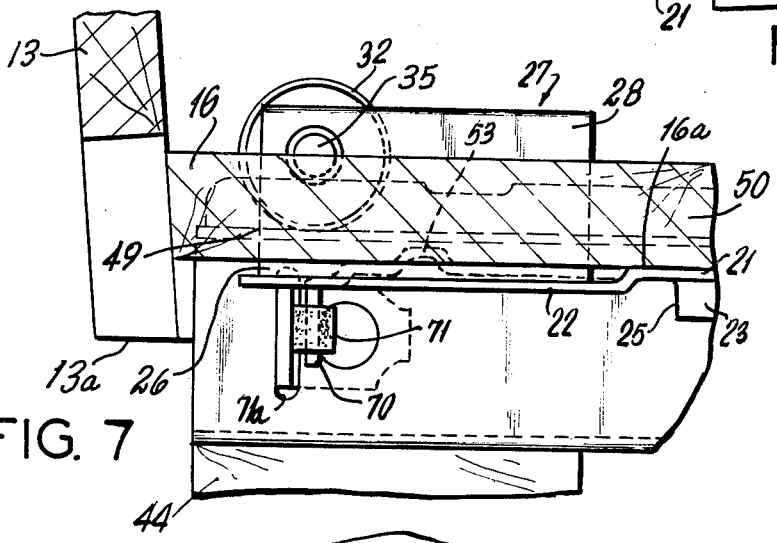
FIG. 7 is a cross-sectional view taken on line 7—7 of FIG. 4.

Attached to the underside 16*a* of brace 16 is upper movable track 20 which as shown in FIGS 5-7 comprises a horizontal web 21 having a depressed or horizontally offset wall portion 22 at its rear end. Extending down from the inner longitudinal end of web 21 is a longitudinal flange 23 terminating short of the rear depressed wall 22, in a front edge 25 (see FIG. 7). Seated on the depressed wall 22 is the horizontal flange 26 of an angle iron 27 more rigid than the movable track member 20. Said angle iron 27 has a vertical flange 28 extending upwardly from the inner end of flange 26, and spaced somewhat from arm rest 12, as shown in FIG. 4. The length of angle iron 27 is only several inches, as is also depressed wall 22. The upper surface of flange 26 is flush with the upper surface of wall 21 and both surfaces contact the underside or undersurface 16*a* of brace 16, as shown in FIG. 7.

As shown in FIGS. 1-3, post 14 has an upward and rearward extension 30 at its upper end connected to an intermediate vertical post 31. The upper ends of posts 31, 13 are connected by a top arm member 31*a*. The wood construction of the arm rests are substantially conventional.

As shown in FIG. 4, fixed to the vertical flange 28 of angle iron 27 is a horizontal axle 35 projecting inwardly and carrying a top wheel 32 with a ball bearing 33 interposed between the axle and wheel.

Returning to FIGS. 1-3, the body 11 of the chair and its movable tracks 20 fixed thereto, are supported for rearward and forward movement by a base 40. Base 40 comprises a front horizontal cross brace 41 having bumpers 42 attached to the underside thereof at its ends thereof, contacting the floor F, and by a rear cross brace 44 having bumpers 45 attached the ends of its under side and contacting said floor. The cross braces 41, 44 are connected by lower parallel stationary tracks 46 supported at the front ends on cross brace 41 and at their rear ends on cross brace 44.

Only the stationary track on the right side is shown, the stationary track on the left side of the chair being similar and symmetrically disposed relative thereto.

As best shown in FIGS. 4 and 5, stationary track 46 has a bottom, horizontal flange 47 resting on cross-braces 41, 44 and extending inwardly from a vertical web 48. Extending horizontally outwardly from web 48 is a shorter web 49 on top of which the top wheel 32 rests and is adapted to roll forward and rearward. Extending up from the outer end of web 49 is a vertical flange 50 spaced somewhat from vertical flange 28 of angle iron 27 as shown in FIG. 4. On axle 35 is an annular disc 51 of nylon or other antifriction material to prevent friction between flange 50 and flange 28. Web 49 is spaced above the upper surface of horizontal flange 26 of angle iron 27 and above the upper surface of wall 21 of the movable track 20. A knob 53, as shown in FIGS. 6 and 7, is punched up from wall 21 at the rear of movable track 20 at the outer side of flange 28. The upper surface of rear knob 53 is spaced somewhat below web 49 to limit upward movement of the movable track 20 and body 11 at the rear of the body.

As shown in FIG. 5, web 48 of fixed track 46 is formed near its front end with an outwardly recessed wall 60 to which is fixed a horizontal axle 61 on which is rotatably mounted by means of a ball bearing, a bottom wheel 62 similar to top wheel 32 and ball bearing 33. Wheel 62 contacts the underside of wall 21. Longitudinal flange 23 is interposed between bottom wheel 62 and web 48. Web 48 is punched outwardly as at 63 (see FIG. 5) and riveted to said punched out wall 63 is a button 64 made of nylon or other anti-friction material contacting flange 23. Thus button 64 and disc 51 reduce friction between the stationary and movable tracks 46, 20 to a minimum. Also, web 49 of the stationary track 46 near its front end has a downwardly punched knob 65 disposed above wall 21 but slightly spaced therefrom to limit upward movement of the movable track. By reason of knobs 65 and 53 even if the tracks warp they will only contact where the knobs 65, 53 are located. These knobs prevent excessive rocking of the body relative to the base.

Means is provided to limit rearward movement of the chair body 11 (and the movable tracks 20 fixed thereto) relative to the base 40 and the stationary tracks 46. To this end, wall 21 of the movable track 20 is provided at its rear end with a downwardly extending lug 70 projecting down below surface 16*a* of brace 16. This lug, as shown in FIGS. 4, 6 and 7, is encircled by a tight flattened band 71 of rubber like material to act as a bumper. A projection 70*a* at the lower end of lug 70 engages the lower edge of band 71 to keep the band on the lug. Web 48 of stationary track 46, at its rear end has a vertical slot 71*a*. Riveted to the inner side of web 48 (see FIG. 4) is one vertical arm 72 of an angular bracket 73. Extending from arm 72 at right angles thereto and passing through slot 71*a* is a second vertical arm 75, lying in the path of lug 70. As the body moves rearwardly, the rubber bumpers 71 on lugs 70 of the movable tracks 20 on opposite sides of the chair body will strike the arms 75 to stop rearward movement of the chair body in the upright position of the chair, as will appear hereinafter.

The chair disclosed herein comprises a seat 74, a back rest 76 and a legrest 77. As will appear hereinafter means is provided to move the seat, back rest and leg rest from an upright position of FIG. 1, to a T.V. reclining position of FIG. 2, to a fully reclined position of FIG. 3, and from fully reclined position back to T.V. position, and from T.V. position back to upright position. During movement from upright position to T.V. position, the back rest tilts rearwardly towards a wall of the room behind the chair. Simultaneously, the chair body 11 and the backrest 76 (which is kinematically connected to the backrest 76 by means of links 79, 89, 111) both move forwardly so that the upper end of the back rest does not move much toward the wall of the room in back of the chair and near it. As the chair moves from T.V. position to fully reclined position, the back rest further tilts rearwardly but the chair body and the bracket 76 both move still further forwardly so that the upper end of the back rest still does not move much toward the wall.

In reverse when the chair moves from fully reclined to T.V. position, the backrest swings up toward vertical but the chair body and the backrest 76 both move rearwardly, and when the chair moves from T.V. position to upright position, the chair body and backrest both move back to their initial positions. The upper end of the backrest remains close to the wall throughout the entire chair movement—a feature characteristic of a wall proximity reclining chair. The means for carrying out these functions will now be described.

Mounted on cross brace 18 and fixed to brace 15 is an armrest mounting member 74*a*, as shown in FIGS. 1–3. Mounting member 74*a* has a vertical flange 76*a*. Extending inwardly from the lower end of flange 76*a* is a horizontal flange 77*a* contacting the top of cross brace 18. Extending angularly downwardly and rearwardly from the rear end of flange 76*a* is an arm 77*b*. Pivoted to the rear lower end of arm 77*b* as at 78 is a link 79. Fixed to the back rest 76 is a bracket 80 comprising an arm 81 parallel to the rear of the back rest. Extending from the lower end of arm 81 is an arm 82 inclined downwardly and forwardly in the upright position of the chair. The upper end of link 79 is pivoted as at 83 to the bracket 80 at the junction of arms 81, 82 of said bracket.

The seat 74 has a rear wall 84, and a front wall 85 interconnected by side walls 86, so as to form a frame which may be upholstered in any suitable fashion. Fixed to the inside of each of the side walls 86 is a seat link 88 having at its rear end an upwardly curved arm 89 pivoted at its upper end, as at 90, to the lower end of arm 82.

Pivoted as at 91 to flange 76*a* near arm 77*b* is a link 92 which extends forwardly. Pivoted to the front end of link 92, as at 93 is a seat drive bell crank 94 which has an arm 95 which is inclined upwardly and forwardly in the upright position of the chair, and an arm 96 which inclines downwardly and forwardly in said position. The pivot 93 is in arm 95 of bell crank 94 near the junction of arms 95, 96. At the outer end of arm 96 is a pin 97. Pivotted to the forward end of wall 76*a* of mounting member 74*a*, as at 98 is a lock link 99 formed with a longitudinal slot 100 receiving said pin 97. In the upright position of FIG. 1, the lock link 99 projects downwardly from its pivot 98. Furthermore in said upright position of the chair, pivots 98 and 93 are coaxial. In said upright position, pin 97 is at the radial inner end of slot 100. The upper end of arm 95 of bell crank 94 is pivoted at 101 to the seat link 88.

Fixed to armrest mounting member 74*a* is a bracket 104 to which is pivoted, as at 105, a short link 106 which projects upwardly. Pivoted to the upper end of link 106, as at 107 is a link 108 crossing link 92 and pivoted thereto as at 109 (see FIG. 3). Pivoted to the rear end of link 108, as at 110 is a link 111 curved rearwardly and upwardly and pivoted at its upper end to the pivot pin 90 which pivotally interconnects seat link 88 to arm 82 of bracket 80.

The fact that the pin 97 is at the radially inner end of the downwardly- and forwardly-extending slot 100 in the upright position of the chair, as well as the further fact that the pin 97 is below pivot 93, prevents link 92 from swinging upwardly until the chair reaches its T.V. position of FIG. 2 at which time the pin 97 is elevated above the floor at approximately the same height as pivot 93. Since link 92 cannot rotate during such movement, link 108 also cannot pivot about pivot pin 107. However the seat link 88 can move backwards causing bell crank 94 to rotate in a clockwise direction about pivot pin 93, thereby allowing the seat link 88 to tilt to T.V. position and the back rest to tilt to T.V. position and allowing the leg rest to be projected forwardly as will be explained hereinafter.

During such movement from upright to T.V. position, lock link 99 swings in a clockwise direction as seen in the drawing from the position of FIG. 1 to the position of FIG. 2. During such movement pin 97 remains at the radially inner end of slot 100 (FIG. 1 and FIG. 2). The linkage which controls the movement of the legrest 77 will now be described. Pivoted to the seat link 88 forwardly of pivot pin 101, as at 114 is a link 115. Pivoted to said seat link 88, forwardly of pivot 114, as at 116 is a link 117. A link 118 is pivoted at one end by a pivot pin 119 to the bell crank 94 at the junction of arms 95, 96 of said bell crank. Said link 118 is pivoted as at pivot 120 to an intermediate portion of link 117. The outer end of link 115 is pivoted as at 121 to a link 122 which crosses link 117 and is pivoted thereto as at 123 between pivot 120 and the outer pivoted end 126 of said link 117. The outer end of link 122 is pivoted at said end to a leg rest bracket 124 as at 125. Leg rest bracket 124 is attached to the underside of the leg rest 77. The outer end of link 117 is pivoted as at 126 to one end of a link 127. The outer end of link 127 is pivoted as at 128 to said bracket 124 in spaced relation to pivot 125.

As the chair moves from upright to T.V. position, the leg rest is projected from the retracted vertical position of FIG. 1 to the projected horizontal position of FIG. 2.

From the T.V. position to FIG. 2, the chair can move to the fully reclined position of FIG. 3 since in the T.V. position of FIG. 2, link 92 can swing up in a clockwise direction about pivot 91 (FIG. 3) while pin 97 moves from the radially inner end of slot 100 to the radially outer end of said slot, due to the rotation of bell crank 94. During the movement of pin 97 in slot 100, the bell crank 94 lifts the pin 97 to an elevation above that of pivot 93, thereby lifting link 92. In FIG. 2, lock link 99 is slightly upwardly inclined relative to the horizontal, but in FIG. 3, said lock link 99 is much further inclined upwardly and forwardly. Thus during movement from T.V. position to fully reclined position, the seat 74 tilts further upwardly and the back rest 76 tilts further rearwardly and downwardly.

The chair cannot go from upright to fully inclined position without first passing to T.V. position and cannot go from fully reclined position to upright position without first going to T.V. position.

Means is provided to move the chair body 11 forwardly upon going from upright position to T.V. position, and then to move said chair body further forwardly upon going from T.V. position to fully reclined position, and for moving the chair body rearwardly upon going from fully reclined position to T.V. position, and to move said body still further rearwardly upon going from T.V. position to upright position. To this end, there is fixed to the inside of the wall 76*a* of each of the armrest mounting members 74*a* at opposite sides of the chair body, by means of rivets 130, 131*a*, 132, 133 or in any other suitable manner, a mounting member metal extension 135 which is in a vertical plane and projects downwardly and forwardly to a point substantially at the level of the wall 21 of the movable track 20 and rearwardly of the lower end 14*a* of the front post 14, just inside web 48 of the stationary track 46. At said point, said extension 135 carries a pivot pin 136, located above the level of cross brace 41 of the base and between the front and rear edges of said cross brace 41, when the chair is in its upright position.

Pivoted to said pivot pin 136 is a base drive bell crank 137 having a shorter arm extending forwardly in horizontal position from said pivot pin 136, in the upright position of the chair. The bell crank 137 is a one piece metal member having a longer arm 139 extending up vertically from the front end of shorter arm 138, looking at the upright position of the chair as illustrated in FIG. 1. At the upper end of arm 139 (FIG. 1) is a pivot pin 140 to pivot a connecting link 141 which is generally inclined downwardly and rearwardly in the upright chair position, and is pivoted to a pivot pin 142 of a base mounting bracket 143 fixed to the top of cross brace 41. As shown in FIG. 1, in the upright position of the chair, arms 139 of bell crank 137 is located just rearwardly of the post 14 and of the vertical leg rest 77 while arm 138 of said bell crank is in horizontal position extending rearwardly from the lower end of arm 139 and terminating in a position forwardly of pivot pin 142. Arm 138 is slightly above the level of pin 142 as shown in FIG. 1.

At the junction of arms 138, 139 of bell crank 137 is a pivot pin 145 to which is pivoted a link 146 which is inclined upwardly and rearwardly in the upright position of the chair. Link 146 is pivoted at its upper end as at 147 to arm 95 of bell crank 94 between pivots 93 and 101.

It will be noted that in going from T.V. to fully reclined positions, pivot 93 moves up relative to pivot 98.

When the chair moves from upright position to T.V. position, bell crank 137 rotates in a clockwise direction looking as FIG. 2, causing the chair body to move forwardly from the position of FIG. 1 to the position of FIG. 2 since bell crank 94 rotates in a clockwise direction about pivot 93, causing link 146 to pull upwardly and rearwardly at pivot 145 to rotate said bell crank 137 to the position of FIG. 2. Such rotation of bell crank 137 causes the chair body to be pulled forwardly due to its connection to pivot 136.

As the chair moves from T.V. position to fully reclined position the chair body is further moved forwardly as the bell crank 137 moves to a position in which its shorter arm 138 is vertical and its longer arm 139 is horizontal as shown in FIG. 3.

The shorter arms 138 on opposite sides of the chair are interconnected by a cross brace 150 which is located generally below the seat at the interior of the chair.

During movement from upright to T.V. position, link 141 rotates in a counter-clockwise direction from FIG. 1 position to FIG. 2 position. During movement from T.V. to fully reclined position, said link 141 rotates further in said counter-clockwise direction to substantially horizontal position. Thus the angle between arm 139 of bell crank 137, and link 141 increases as the chair moves from upright to fully reclined positions.

It will now be understood that the side arms of the chair herein are not connected by an armrest cross brace at the lower front end of the chair body as in copending application Ser. No. 683,480, now U.S. Pat. No. 4,077,663, thereby obviating the necessity for making the bell crank 137 of a number of pieces, and permitting the bell crank 137 to be made of one piece as herein, with the short arm 138 extending from its junction with arm 139 as there is no need to straddle any cross-brace. Furthermore the metal extension or reinforcing means 135 is rigid and not subject to being destroyed after prolonged use as is the case with armrest wood cross brace of said copending application. Yet further, the elimination of the armrest cross piece 16 of said copending application permits designing the linkage herein for the leg rest 77 to move through the space created by removal of the armrest cross-brace. In said copending application the leg rest projecting linkage had to move only above the armrest cross brace 16 therein which was restrictive in terms of the overall design of the chair.

Figure 10:
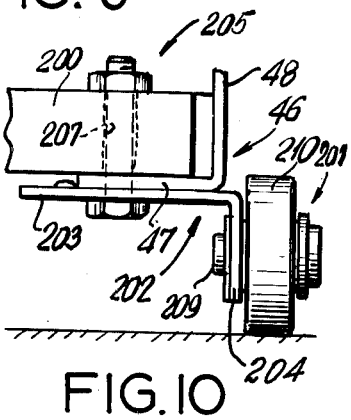
FIG. 10 is a partial vertical rear end view at the right side of the chair, of the base and caster of FIGS. 8 and 9.
Figure 8:
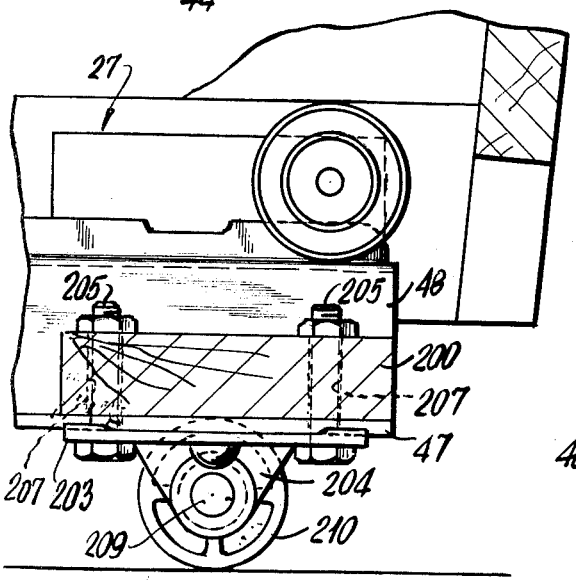
FIG. 8 is a partial vertical cross-sectional view of the lower rear end of a chair, embodying the invention but illustrating a modified construction.
Figure 9:
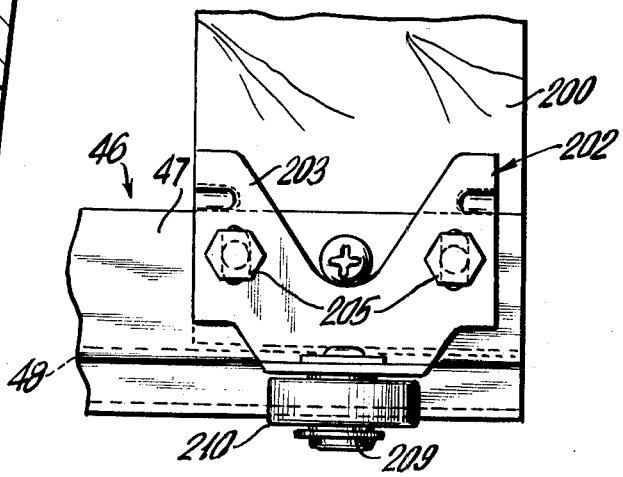
FIG. 9 is a bottom plan view looking upwardly at the construction shown in FIG. 8.

In FIGS. 8, 9 and 10 there is illustrated a modification of the structure shown in FIGS. 1–7. In FIGS. 1–7 the rear cross bar 44 is attached to the underside of flanges 48 of the stationary tracks and has bumpers or pads 45 at its underside.

In FIGS. 8, 9 and 10, a rear cross bar 200 is mounted on the flanges 47 of the stationary track 46. The end edges of the cross bar 200 substantially abut webs 48 of the stationary tracks. Attached to the stationary tracks and to the cross brace 200 at the ends of the cross-brace are casters 201. Each caster comprises an angle bracket 202 having a horizontal flange 203 contacting the underside of the flange 47. Extending down from the outer end of each flange 203 is a flange 204. The attachment of the angle bracket 202 to the stationary track and cross-brace is by means of bolts 205 passing through registering openings in said flanges 203, 47 and through openings 207 in the cross-brace 200. Flange 204 of the bracket 202 carries an axle 209 on which a wheel or roller 210 is rotatably mounted.

The purpose of the casters is to permit the user to tilt the chair by lifting up the front end thereof, for example at the leg rest 77, and then moving the chair easily in wheelbarrow-like manner away from the room wall because the chair then can roll on the rollers or wheels 210.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

I claim:

1. In a wall-clearing reclining chair of the type comprising (A) a base for supporting the chair on the floor;

(B) a seat located generally above the base and having a pair of seat-mounting members each located at an opposite side of the seat;

(C) a movable armrest assembly mounted for longitudinal horizontal reciprocating movement relative to the base, said armrest assembly including (1) a pair of armrests each located at an opposite side of the seat, (2) means for interconnecting the armrests including a pair of armrest-mounting members mounted on each armrest at a predetermined location below the seat, and (3) a pair of movable tracks each mounted for said reciprocating movement relative to the base, said interconnected armrests being mounted on the movable tracks to move forwardly and rearwardly together with the latter as a unit;

(D) seat drive linkage means operatively connecting the seat-mounting members to the armrest-mounting members, for successively moving the seat from an end-limiting upright position to an end-limiting fully reclined position, all in response to forward movement of the armrest assembly, said seat drive linkage means also being operative for successively moving the seat from the fully reclined position back to the upright position, all in response to rearward movement of the armrest assembly; and (E) base drive linkage means operatively connecting the seat drive linkage means to the base, said base drive linkage means having for each armrest-mounting member a pivot pin which is located both forwardly and downwardly of the respective predetermined location of the associated armrest-mounting member;

the improvement comprising:

extension means for transmitting the force generated at each armrest-mounting member during said reciprocating movement of the armrest assembly directly to its associated pivot pin, said extension means including a pair of forcetransmitting elongated extension members, each having one end region at a respective armrest-mounting member, an opposite end region at the respective pivot pin, and an intermediate extension portion which extends from said one end region downwardly and forwardly of the associated predetermined location of the respective armrest-mounting member to said opposite end region, each extension member being made of forcetransmitting rigid material for transmitting the forwardly and rearwardly-directed forces generated during said reciprocating movement of the armrest assembly at the armrest-mounting members thereof directly to their respective pivot pins, whereby each pivot pin is reliably reciprocably guided along a longitudinal horizontal path relative to the base.

2. The improvement as defined in claim 1, wherein each armrest has a front portion and a rear portion, and wherein said armrest-mounting members are mounted only at the rear portions of the armrests to thereby leave the associated front portions unconnected to each other; and wherein each extension member is laterally spaced from its associated front armrest portion to thereby define a clearance space therewith; and further comprising a footrest, a pair of footrest-mounting members, and footrest drive linkage means operatively connecting the footrest-mounting member to the seat drive linkage means, for successively extending the footrest in one direction from an end-limiting folded position to an end-limiting fully extended position, all in response to forward movement of the armrest assembly, and also for successively retracting the footrest in the opposite direction back to the folded position, all in response to rearward movement of the armrest assembly, said footrest drive linkage means being receivable in and movable through each clearance space.

3. The improvement as defined in claim 1, wherein said base drive linkage means includes a pair of front drive bell cranks each pivotally connected to its associated pivot pin and having a pair of arms and a bridging bracket, said arms and said bracket of each pair of front bell cranks all being of one-piece construction.

4. The improvement as defined in claim 3; and further comprising an elongated bridging member extending between and fixedly connected to each bridging bracket to thereby prevent undesired lateral shifting of the front drive bell cranks relative to each other.

5. The improvement as defined in claim 3, wherein each bracket of a front drive bell crank is of one-piece with one of said arms, and wherein the other of said arms extends generally normally of said one arm.

6. The improvement as defined in claim 3, wherein said base drive linkage means further includes a base-mounting bracket and an elongated base link having one end pivotally mounted to the base-mounting bracket, and its opposite end pivotally connected to said front drive bell crank.

7. The improvement as defined in claim 3, wherein said base drive linkage means also includes connecting means for pivotally connecting each front drive bell crank to the seat drive linkage means, said connecting means including an elongated connecting link having one end region pivotally connected to the seat drive linkage means, and its opposite end region pivotally connected to the front drive bell crank at the juncture of the two arms thereof.

8. The improvement as defined in claim 1, wherein each extension member is constituted by metal material.

9. The improvement as defined in claim 1; and further comprising a back, a backrest-mounting member, and backrest drive linkage means operatively connected to the seat drive linkage means, for successively moving the back from an end-limiting upright position to an end-limiting fully reclined position, all in response to forward movement of the armrest assembly, and also operative for successively moving the back from the fully reclined position back to the upright position, all in response to rearward movement of the armrest assembly.

10. The improvement as defined in claim 1, and further comprising means for mounting each movable track on the base for said reciprocating movement relative thereto, and means for reinforcing each track at the location of said track-mounting means thereon, said reinforcing means including a pair of reinforcement elements each fixedly mounted on a respective movable track and each having said track-mounting means mounted thereon, each reinforcement element being constituted by a material which is more resistant to deformation as compared to the material of the movable tracks, whereby each movable track is strengthened in the vicinity of its track-mounting means where most of the weight of the user and of the armrest assembly is concentrated.

11. The improvement as defined in claim 1, and further comprising abutment means on each of the movable tracks and movable together with the same during said reciprocating movement; and also comprising stop means fixedly mounted at the rear of the base and extending into the path of movement of the abutment means, said stop means being operative for arresting movement of the seat in its upright position, and also for preventing further rearward movement of the armrest assembly and its movable tracks past said abutment means.

12. The improvement as defined in claim 1, and further comprising front base support means located at a forward region of the base, said front base support means being liftable from a chair supporting position in which the front base support means engages the floor and supports the base forward region, to a tilted chair position in which the front base support means is elevated above the floor; and also comprising rear base support means located at a rearward region of the base, said rear base support means including a pair of caster wheel assemblies at opposite sides of the base rearward region, each caster wheel assembly having a rotary wheel in constant rolling engagement with the floor during the entire lifting movement of said front base support means, whereby the chair is easily rolled for cleaning underneath the same.

13. In a wall-clearing reclining chair of the type comprising (A) a base for supporting the chair on the floor;

(B) a seat located generally above the base and having a pair of seat-mounting members each located at an opposite side of the seat;

(C) a movable armrest assembly mounted for longitudinal horizontal reciprocating movement relative to the base, said armrest assembly including (1) a pair of armrests each located at an opposite side of the seat and having a bottom surface which faces and is located above the floor, and (2) means for interconnecting the armrests including a pair of armrest-mounting members mounted on each armrest below the seat; and (D) seat drive linkage means operative connecting the seat-mounting members to the armrest-mounting members, for successively moving the seat from an end-limiting upright position to an end-limiting fully reclined position, all in response to forward movement of the armrest assembly, said seat drive linkage means also being operative for successively moving the seat from the fully reclined position back to the upright position, all in response to rearward movement of the armrest assembly;

the improvement comprising:

(a) a pair of elongated movable tracks located at opposite sides of the seat, each movable track having an armrest-supporting wall on which the bottom surface of the respective armrest is fixedly mounted;

(b) means for mounting each movable track on the base for longitudinal horizontal reciprocating movement relative thereto so that the interconnected armrests move forwardly and rearwardly as a unit together with the movable tracks relative to the base; and (c) means for reinforcing each track at the location of said track-mounting means thereon, said reinforcing means including a pair of reinforcement elements each fixedly mounted on a respective movable track and each having said track-mounting means mounted thereon, each reinforcement element being constituted by a material which is more resistant to deformation as compared to the material of the movable tracks, whereby each movable track is strengthened in the vicinity of its track-mounting means where most of the weight of the user and of the armrest assembly is concentrated.

14. The improvement as defined in claim 13, wherein each movable track has a generally planar front portion which is located at a predetermined elevation relative to the base, and a rear offset portion which is located at an elevation lower than said predetermined elevation; and wherein each reinforcement element has a generally horizontal planar part fixedly mounted in said rear offset portion of each movable track, each planar part having a thickness such that the upper planar surface of the latter lies in substantially the same horizontal plane as the upper planar surface of the planar front portion of the movable track, said planar part and said planar portion together defining said armrest-supporting wall.

15. The improvement as defined in claim 14, wherein each reinforcement element also has a generally vertical planar part of one-piece with its associated generally horizontal planar part, said track-mounting means being mounted on each vertical planar part.

16. The improvement as defined in claim 14, wherein each planar front portion extends over a major portion of the length of the respective movable track, and wherein each respective rear offset portion extends over the remaining minor portion of the track length.

17. The improvement as defined in claim 13; and further comprising a pair of stationary tracks fixedly mounted on the base, and wherein said track-mounting means includes a rotary top wheel mounted at the rear of each movable track for rolling movement on a respective stationary track.

18. The improvement as defined in claim 17; and further comprising auxiliary track-mounting means including a rotary bottom wheel mounted at the front of each stationary track for rolling movement on a respective movable track.

19. The improvement as defined in claim 18, wherein each stationary track has a generally horizontal rolling surface, and wherein said top wheel rollingly engages the upper side of said rolling surface, and wherein said bottom wheel rollingly engages the lower side of said rolling surface.

20. The improvement as defined in claim 19, wherein each stationary track and its associated movable track have opposing walls spaced laterally apart of each other; and further comprising anti-friction spacer means intermediate said opposing walls for maintaining the latter in spaced relation during said reciprocating movement with minimal friction loss.

21. The improvement as defined in claim 13, wherein each armrest-mounting member is mounted on each armrest at a predetermined location below the seat; wherein the chair also includes base drive linkage means operatively connecting the seat drive linkage means to the base, said base drive linkage means having for each armrest-mounting member a pivot pin which is located both forwardly and downwardly of the respective predetermined location of the associated armrest-mounting member; and further comprising extension means for transmitting the force generated at each armrest-mounting member during said reciprocating movement of the armrest assembly directly to its associated pivot pin, said extension means including a pair of force-transmitting elongated extension members, each having one end region at a respective armrest-mounting member, an opposite end region at the respective pivot pin, and an intermediate extension portion which extends from said one end region downwardly and forwardly of the associated predetermined location of the respective armrestmounting member to said opposite end region, each extension member being made of force-transmitting rigid material for transmitting the forwardly- and rearwardly-directed forces generated during said reciprocating movement of the armrest assembly at the armrest-mounting members thereof directly to their respective pivot pins, whereby each pivot pin is reliably reciprocably guided along a longitudinal horizontal path relative to the base.

22. The improvement as defined in claim 13; and further comprising abutment means on each of the movable tracks and movable together with the same during said reciprocating movement; and also comprising stop means fixedly mounted at the rear of the base and extending into the path of movement of the abutment means, said stop means being operative for arresting movement of the seat in its upright position, and also for preventing further rearward movement of the armrest assembly and its movable tracks past said abutment means.

23. The improvement as defined in claim 13; and further comprising front base support means located at a forward region of the base, said front base support means being liftable from a chair supporting position in which the front base support means engages the floor and supports the base forward region, to a tilted chair position in which the front base support means is elevated above the floor; and also comprising rear base support means located at a rearward region of the base, said rear base support means including a pair of caster wheel assemblies at opposite sides of the base rearward region, each caster wheel assembly having a rotary wheel in constant rolling engagement with the floor during the entire lifting movement of said front base support means, whereby the chair is easily rolled for cleaning underneath the same.

24. In a wall-clearing reclining chair of the type comprising (A) a base for supporting the chair on a floor;

(B) a seat located generally above the base and having a pair of seat-mounting members each located at an opposite side of the seat;

(C) a movable armrest assembly mounted for longitudinal horizontal reciprocating movement relative to the base, said armrest assembly including (1) a pair of armrests each located at an opposite side of the seat, (2) means for interconnecting the armrests including a pair of armrest-mounting members mounted on each armrest below the seat, and (3) a pair of movable tracks each mounted for said reciprocating movement relative to the base, said interconnected armrests being mounted on the movable tracks to move forwardly and rearwardly together with the latter as a unit; and (D) seat drive linkage means operative connecting the seat-mounting members to the armrest-mounting members, for successively moving the seat from an end-limiting upright position to an end-limiting fully reclined position, all in response to forward movement of the armrest assembly, said seat drive linkage means also being operative for successively moving the seat from the fully reclined position back to the upright position, all in response to rearward movement of the armrest assembly;

the improvement comprising:

(a) abutment means on each of the movable tracks and movable together with the same during said reciprocating movement; and (b) stop means fixedly mounted at the rear of the base and extending into the path of movement of the abutment means, said stop means being operative for arresting movement of the seat in its upright position, and also for preventing further rearward movement of the armrest assembly and its movable tracks past said abutment means.

25. The improvement as defined in claim 24; and further comprising a pair of stationary tracks mounted on the base at opposite sides of the seat, and wherein said abutment means includes a pair of abutments each fixedly connected to a respective stationary track, and wherein said stop means includes a pair of stops each fixedly connected to a respective movable track.

26. The improvement as defined in claim 24; and further comprising elastomeric means mounted intermediate said stop means and said abutment means.

27. The improvement as defined in claim 26, wherein said elastomeric means constitutes an endless band mounted on said abutment means; and further comprising means for retaining said band on said abutment means.

28. The improvement as defined in claim 27, wherein said abutment means includes a pair of abutments each extending downwardly in direction towards the base, and wherein said retaining means constitutes a transversely-extending projection on each abutment for securing the respective band on the latter.

29. The improvement as defined in claim 24, wherein each armrest-mounting member is mounted on each armrest at a predetermined location below the seat; wherein the chair also includes base drive linkage means operatively connecting the seat drive linkage means to the base, said base drive linkage means having for each armrest-mounting member a pivot pin which is located both forwardly and downwardly of the respective predetermined location of the associated armrest-mounting member; and further comprising extension means for transmitting the force generated at each armrest-mounting member during said reciprocating movement of the armrest assembly directly to its associated pivot pin, said extension means including a pair of force-transmitting elongated extension members, each having one end region at a respective armrest-mounting member, an opposite end region at the respective pivot pin, and an intermediate eztension portion which extends from said one end region downwardly and forwardly of the associated predetermined location of the respective armrest-mounting member to said opposite end region, each extension member being made of force-transmitting rigid material for transmitting the forwardly- and rearwardly-directed forces generated during said reciprocating movement of the armrest assembly at the armrest-mounting members thereof directly to their respective pivot pins, whereby each pivot pin is reliably reciprocably guided along a longitudinal horizontal path relative to the base.

30. The improvement as defined in claim 24; and further comprising means for mounting each movable track on the base for said reciprocating movement relative thereto, and means for reinforcing each track at the location of said track-mounting means thereon, said reinforcing means including a pair of reinforcement elements each fixedly mounted on a respective movable track and each having said track-mounting means mounted thereon, each reinforcement element being constituted by a material which is more resistant to deformation as compared to the material of the movable tracks, whereby each movable track is strengthened in the vicinity of its track-mounting means where most of the weight of the user and of the armrest assembly is concentrated.

31. The improvement as defined in claim 24; and further comprising front base support means located at a forward region of the base, said front base support means being liftable from a chair supporting position in which the front base support means engages the floor and supports the base forward region, to a tilted chair position in which the front base support means is elevated above the floor; and also comprising rear base support means located at a rearward region of the base, said rear base support means including a pair of caster wheel assemblies at opposite sides of the base rearward region, each caster wheel assembly having a rotary wheel in constant rolling engagement with the floor during the entire lifting movement of said front base support means, whereby the chair is easily rolled for cleaning underneath the same.

32. In a wall-clearing reclining chair of the type comprising (A) a base for supporting the chair on a floor;

(B) a seat located generally above the base and having a pair of seat-mounting members each located at an opposite side of the seat;

(C) a movable armrest assembly mounted for longitudinal horizontal reciprocating movement relative to the base, said armrest assembly including (1) a pair of armrests each located at an opposite side of the seat, (2) means for interconnecting the armrests including a pair of armrest-mounting members mounted on each armrest below the seat, and (3) a pair of movable tracks each mounted for said reciprocating movement relative to the base, said interconnected armrests being mounted on the movable tracks to move forwardly and rearwardly together with the latter as a unit;

(D) seat drive linkage means operatively connecting the seat-mounting members to the armrest-mounting members, for successively moving the seat from an end-limiting upright position to an end-limiting fully reclined position, all in response to forward movement of the armrest assembly, said seat drive linkage means also being operative for successively moving the seat from the fully reclined position back to the upright position, all in response to rearward movement of the armrest assembly;

the improvement comprising:

(a) front base support means located at a forward region of the base, said front base support means being liftable from a chair-supporting position in which the front base support means engages the floor and supports the base forward region, to a tilted chair position in which the front base support means is elevated above the floor; and (b) rear base support means located at a rearward region of the base, said rear base support means including a pair of caster wheel assemblies at opposite sides of the base rearward region, each caster wheel assembly having a rotary wheel in constant rolling engagement with the floor during the entire lifting movement of said front base support means, whereby the chair is easily rolled for cleaning underneath the same.

33. The improvement as defined in claim 32, wherein each caster wheel assembly includes an L-shaped bracket having a generally horizontal arm mounted at the underside of the base rearward region, and a generally vertical arm of onepiece with the horizontal bracket arm and on which the respective rotary wheel is rotatably mounted.

34. The improvement as defined in claim 32; and further comprising a footrest, a pair of footrest-mounting members, and footrest drive linkage means operatively connecting the footrest-mounting member to the seat drive linkage means, for successively extending the footrest in one direction from an end-limiting folded position to an end-limiting fully extended position, all in response to forward movement of the armrest assembly, and also for successively retracting the footrest in the opposite direction back to the folded position, all in response to rearward movement of the armrest assembly.

35. The improvement as defined in claim 32, wherein each armrest-mounting member is mounted on each armrest at a predetermined location below the seat; wherein the chair also includes base drive linkage means operatively connecting the seat drive linkage means to the base, said base drive linkage means having for each armrest-mounting member a pivot pin which is located both forwardly and downwardly of the respective predetermined location of the associated armrest-mounting member; and further comprising extension means for transmitting the force generated at each armrest-mounting member during said reciprocating movement of the armrest assembly directly to its associated pivot pin, said extension means including a pair of force-transmitting elongated extension members, each having one end region at a respective armrest-mounting member, an opposite end region at the respective pivot pin, and an intermediate extension portion which extends from said one end region downwardly and forwardly of the associated predetermined location of the respective armrest-mounting member to said opposite end region, each extension member being made of force-transmitting rigid material for transmitting the forwardly- and rearwardly-directed forces generated during said reciprocating movement of the armrest assembly at the armrest-mounting members thereof directly to their respective pivot pins, whereby each pivot pin is reliably reciprocably guided along a longitudinal horizontal path relative to the base.

36. The improvement as defined in claim 32; and further comprising means for mounting each movable track on the base for said reciprocating movement relative thereto, and means for reinforcing each track at the location of said track-mounting means thereon, said reinforcing means including a pair of reinforcement elements each fixedly mounted on a respective movable track and each having said track-mounting means mounted thereon, each reinforcement element being constituted by a material which is more resistant to deformation as compared to the material of the movable tracks, whereby each movable track is strengthened in the vicinity of its track-mounting means where most of the weight of the user and of the armrest assembly is concentrated.

37. The improvement as defined in claim 32; and further comprising abutment means on each of the movable tracks and movable together with the same during said reciprocating movement; and also comprising stop means fixedly mounted at the rear of the base and extending into the path of movement of the abutment means, said stop means being operative for arresting movement of the seat in its upright position, and also for preventing further rearward movement of the armrest assembly and its movable tracks past said abutment means.

38. Hardware for a wall-clearing reclining chair of the type having (A) a base for supporting the chair on a floor;

(B) a seat located generally above the base;

(C) a movable armrest assembly mounted for longitudinal horizontal reciprocating movement relative to the base, including a pair of armrests each located at an opposite side of the seat, said hardware including (1) a pair of seat-mounting members each located at an opposite side of the seat;

(2) means for interconnecting the armrests including a pair of armrest-mounting members mounted on each armrest at a predetermined location below the seat;

(3) a pair of movable tracks each mounted for said reciprocating movement relative to the base, said interconnected armrest-mounting members being mounted on the movable tracks to move forwardly and rearwardly together with the latter as a unit;

(4) seat drive linkage means operatively connecting the seat-mounting members to the armrest-mounting members, for successively moving the seat-mounting members from an end-limiting upright position to an end-limiting fully reclined position, all in response to forward movement of the armrest assembly, said seat drive linkage means also being operative for successively moving the seat-mounting members from the fully reclined position back to the upright position, all in response to rearward movement of the armrest assembly; and (5) base drive linkage means operatively connecting the seat drive linkage means to the base, said base drive linkage means having for each armrest-mounting member a pivot pin which is located both forwardly and downwardly of the respective predetermined location of the associated armrest-mounting member;

the improvement comprising:

extension means for transmitting the force generated at each armrest-mounting member during said reciprocating movement of the armrest assembly directly to its associated pivot pin, said extension means including a pair of force-transmitting elongated extension members, each having one end region at a respective armrest-mounting member, an opposite end region at the respective pivot pin, and an intermediate extension portion which extends from said one end region downwardly and forwardly of the associated predetermined location of the respective armrest-mounting member to said opposite end region, each extension member being made of force-transmitting rigid material for transmitting the forwardly- and rearwardly-directed forces generated during said reciprocating movement of the armrest assembly at the armrest-mounting members thereof directly to their respective pivot pins, whereby each pivot pin is reliably reciprocably guided along a longitudinal horizontal path relative to the base.

39. Hardware for a wall-clearing reclining chair of the type having (A) a base for supporting the chair on a floor;

(B) a seat located generally above the base;

(C) a movable armrest assembly mounted for longitudinal horizontal reciprocating movement relative to the base, including a pair of armrests each located at an opposite side of the seat and having a bottom surface which faces and is located above the floor, said hardware including (1) a pair of seat-mounting members each located at an opposite side of the seat;

(2) means for interconnecting the armrests including a pair of armrest-mounting members mounted on each armrest below the seat; and (3) seat drive linkage means operatively connecting the seat-mounting members to the armrest-mounting members, for successively moving the seat-mounting members from an end-limiting upright position to an end-limiting fully reclined position, all in response to forward movement of the armrest assembly, said seat drive linkage means also being operative for successively moving the seat-mounting members from the fully reclined position back to the upright position, all in response to rearward movement of the armrest assembly;

the improvement comprising:

(a) a pair of elongated movable tracks located at opposite sides of the seat, each movable track having an armrest-supporting wall on which the bottom surface of the respective armrest is fixedly mounted;

(b) means for mounting each movable track on the base for longitudinal horizontal reciprocating movement relative thereto so that the interconnected armrest-mounting members move forwardly and rearwardly as a unit together with the movable tracks relative to the base; and (c) means for reinforcing each track at the location of said track-mounting means thereon, said reinforcing means including a pair of reinforcement elements each fixedly mounted on a respective movable track and each having said track-mounting means mounted thereon, each reinforcement element being constituted by a material which is more resistant to deformation as compared to the material of the movable tracks whereby each movable track is strengthened in the vicinity of its track-mounting means where most of the weight of the user and of the armrest assembly is concentrated.

40. Hardware for a wall-clearing reclining chair of the type having (A) a base for supporting the chair on a floor;

(B) a seat located generally above the base;

(C) a movable armrest assembly mounted for longitudinal horizontal reciprocating movement relative to the base, including a pair of armrests each located at an opposite side of the seat;

said hardware including (1) a pair of seat-mounting members each located at an opposite side of the seat;

(2) means for interconnecting the armrests including a pair of armrest-mounting members mounted on each armrest below the seat;

(3) a pair of movable tracks each mounted for said reciprocating movement relative to the base, said interconnected armrest-mounting members being mounted on the movable tracks to move forwardly and rearwardly together with the latter as a unit; and (4) seat drive linkage means operatively connecting the seat-mounting members to the armrest-mounting members, for successively moving the seat-mounting members from an end-limiting upright position to an end-limiting fully reclined position, all in response to forward movement of the armrest assembly, said seat drive linkage means also being operative for successively moving the seat-mounting members from the fully reclined position back to the upright position, all in response to rearward movement of the armrest assembly;

the improvement comprising:

(a) abutment means on each of the movable tracks and movable together with the same during said reciprocating movement; and (b) stop means fixedly mounted at the rear of the base and extending into the path of movement of the abutment means, said stop means being operative for arresting movement of the seat-mounting members in their upright position, and also for preventing further rearward movement of the armrest assembly and its movable tracks past said abutment means.

41. Hardware for a wall-clearing reclining chair of the type having (A) a base for supporting the chair on a floor;

(B) a seat located generally above the base; and (C) a movable armrest assembly mounted for longitudinal horizontal reciprocating movement relative to the base including a pair of armrests each located at an opposite side of the seat, said hardware including (1) a pair of seat-mounting members each located at an opposite side of the seat;

(2) means for interconnecting the armrests including a pair of armrest-mounting members mounted on each armrest below the seat;

(3) a pair of movable tracks each mounted for said reciprocating movement relative to the base, said interconnected armrests being mounted on the movable tracks to move forwardly and rearwardly together with the latter as a unit; and (4) seat drive linkage means operatively connecting the seat-mounting members to the armrest-mounting members, for successively moving the seat-mounting members from an end-limiting upright position to an end-limiting fully reclined position, all in response to forward movement of the armrest assembly, said seat drive linkage means also being operative for successively moving the seat-mounting members from the fully reclined position back to the upright position, all in response to rearward movement of the armrest assembly;

the improvement comprising:

(a) front base support means located at a forward region of the base, said front base support means being liftable from a chair-supporting position in which the front base support means engages the floor and supports the base forward region, to a tilted chair position in which the front base support means is elevated above the floor; and (b) rear base support means located at a rearward region of the base, said rear base support means including a pair of caster wheel assemblies at opposite sides of the base rearward region, each caster wheel assembly having a rotary wheel in constant rolling engagement with the floor during the entire lifting movement of said front base support means, whereby the chair is easily rolled for cleaning underneath the same.

* * * * *